US009120026B2

(12) United States Patent
Hedeen, Jr. et al.

(10) Patent No.: US 9,120,026 B2
(45) Date of Patent: Sep. 1, 2015

(54) TOY PROJECTILE

(71) Applicant: Hedeen International, LLC, Sturgeon Bay, WI (US)

(72) Inventors: Clemens V. Hedeen, Jr., Sturgeon Bay, WI (US); Kay Lee Hedeen, Sturgeon Bay, WI (US); Michael T. Keyser, Sturgeon Bay, WI (US)

(73) Assignee: Hedeen International, LLC, Sturgeon Bay, WI (US)

( * ) Notice: Subject to any disclaimer, the term of this patent is extended or adjusted under 35 U.S.C. 154(b) by 61 days.

(21) Appl. No.: 14/105,416

(22) Filed: Dec. 13, 2013

(65) Prior Publication Data

US 2015/0165332 A1 Jun. 18, 2015

(51) Int. Cl.
*A63H 13/10* (2006.01)
*A63H 11/06* (2006.01)

(52) U.S. Cl.
CPC ..... *A63H 11/06* (2013.01)

(58) Field of Classification Search
USPC ..... 446/63, 230, 231, 308–311, 435; 124/16, 26
See application file for complete search history.

(56) References Cited

U.S. PATENT DOCUMENTS 202,990 A 4/1878 Chinnock
847,755 A 3/1907 Flora
1,062,129 A * 5/1913 Sweeney ..... 446/310
2,598,807 A * 6/1952 Lawson, Jr. et al. ..... 446/9
2,751,711 A * 6/1956 Greenwood ..... 446/399
2,858,644 A * 11/1958 Derham ..... 446/310
2,923,089 A * 2/1960 Fissel ..... 446/231
3,108,395 A * 10/1963 Goldfarb ..... 446/311
3,191,342 A * 6/1965 Chalmers ..... 446/231
3,286,392 A 11/1966 Fortunato
3,572,715 A * 3/1971 Ramirez ..... 473/569
3,581,434 A * 6/1971 Fels ..... 446/309
3,793,765 A * 2/1974 Schatz ..... 446/231
3,949,518 A * 4/1976 Lenza ..... 446/186
4,453,338 A * 6/1984 Lehman ..... 446/46
6,343,969 B1 2/2002 Spector
6,752,682 B1 * 6/2004 Ferrell ..... 446/230

FOREIGN PATENT DOCUMENTS

WO 02072221 A1 9/2002

* cited by examiner

*Primary Examiner* — Kurt Fernstrom
(74) *Attorney, Agent, or Firm* — Gifford, Krass, Sprinkle, Anderson & Citkowski, P.C.; Mark D. Schneider

(57) ABSTRACT

A toy projectile apparatus and method are disclosed in which the apparatus may include an elongated body having a wall defining an open interior, a closed end and an open end. A base member may be positioned in the open interior and configured to be moveable along the length thereof. A spring may also be positioned in the interior of the body with one end contacting the closed end of the body and another end contacting the base member so that the base member is biased toward the open end of the body. A resilient member or cap may also be mounted on an exterior of the body at the closed end. One or more toy accessories may also be used in conjunction with the toy projectile apparatus.

10 Claims, 6 Drawing Sheets

TOY PROJECTILE

FIELD OF THE INVENTION

A toy projectile is disclosed that may be launched from a user's finger or the like. The toy may also be combined with an accessory, such as a toy cart or glider, for enhanced capability and fun.

BACKGROUND OF THE INVENTION

Popping or jumping toys have been available in the marketplace for more than a century. For example, U.S. Pat. No. 202,990 (1878) to Chinnock disclosed a jumping toy in the form of a doll. In 2002, U.S. Pat. No. 6,343,969 to Spector disclosed a figure that may be launched by inserting a post into the figure to engage an elastic spring concealed in the figure. And, in 1996, U.S. Pat. No. 3,286,392 to Fortunato disclosed a toy rocket and launching assembly in which a post was inserted into a rocket body that engaged a rubber band for propelling the rocket. However, while popping toys have been available for some time, considerable room remains for advancement in the art.

SUMMARY OF THE INVENTION

An embodiment of a toy projectile apparatus is disclosed that may include an elongated body having an open interior, a closed end, and an open end. A base member may be positioned inside the interior of the body and shaped or otherwise configured so that it may be moved along the length of the interior. A spring may also be positioned in the interior that has one end in contact with the closed end of the body and another end in contact with the base member. As a result, the spring may function to bias the base member toward and/or against the open end when in a rest state. In addition, a resilient member or cap may be fixed or otherwise mounted to the exterior of the body at the closed end.

The body may be tubular in shape with the base member having a diameter less than the diameter of the interior of the body. The base member may include a center aperture and also cutouts along a perimeter/edge that respectively provides a positioning contact for a user's finger and permits for venting of air in the interior during use/launch. The spring may be a metal coil spring, but other types of springs and materials may also be used. In addition, an accessory apparatus (such as a toy glider or toy car) may be removably mounted to the toy apparatus to allow for increased fun and enjoyment by the user.

In operation, a user may hold the toy projectile apparatus with one hand while inserting a finger into the center aperture of the base member and applying a force to drive the base member into the interior and compress the spring. Then, to launch the toy projectile, the user simply releases his or her hold on the body and allows the spring action to launch the apparatus off the user's finger.

BRIEF DESCRIPTION OF THE DRAWINGS

Reference will now be made to the associated drawings in which like reference numerals refer to like parts throughout and wherein.

DETAILED DESCRIPTION OF THE PREFERRED EMBODIMENTS

A toy projectile apparatus may include an elongated body having a side wall that defines an open interior, a closed end and an open end. A base member may be positioned in the interior and shaped or otherwise configured so that it is movable along the length of the interior. A spring may also be positioned in the interior that has one end in contact with the closed end and the opposite end in contact with the base member. As a result, the spring may function to bias the base member towards the open end. A resilient member or cap may be mounted on the exterior end of the body at the closed end.

Figure 1:
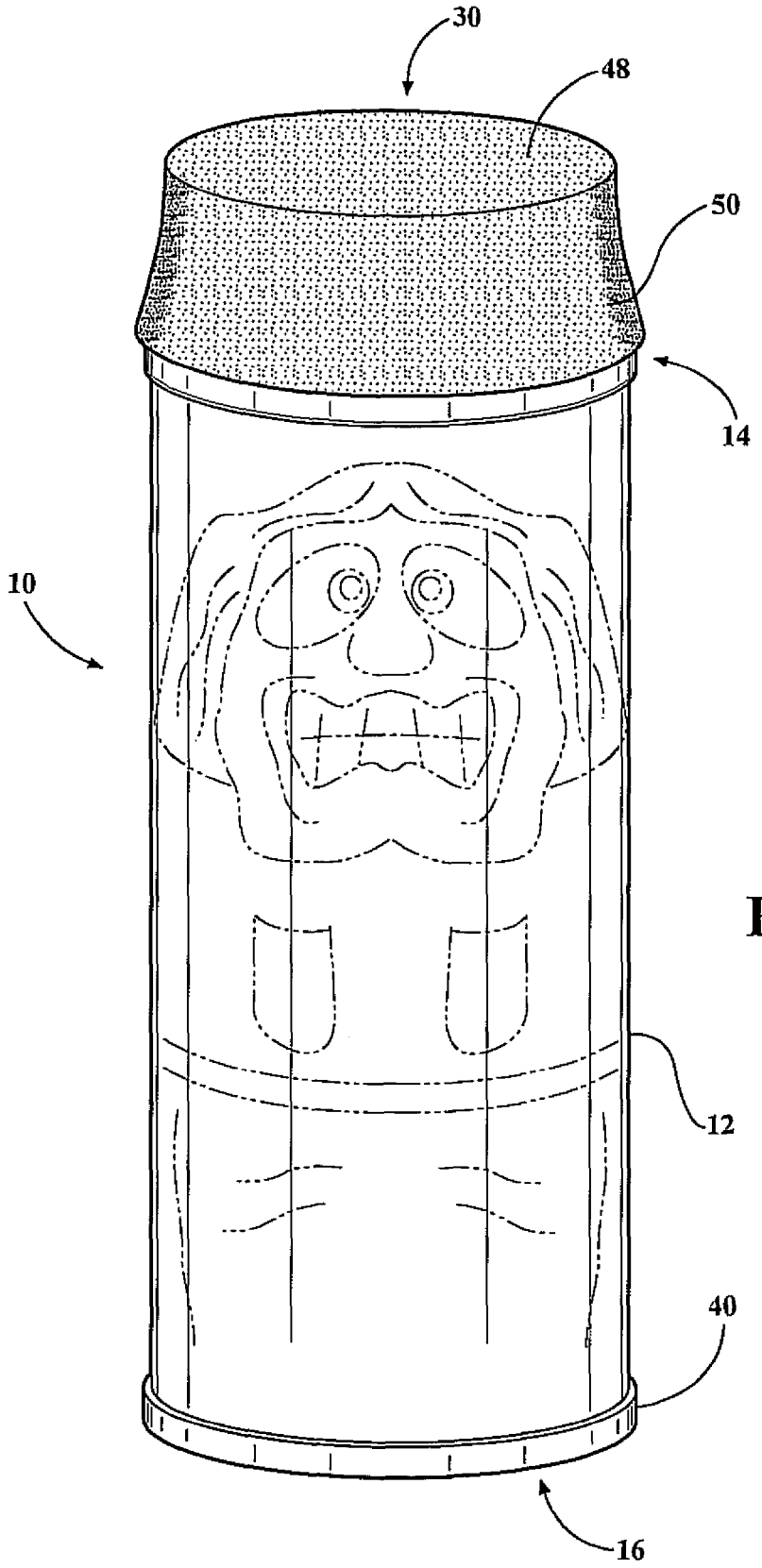
FIG. 1 is a perspective view of an embodiment of a toy projectile apparatus according to one embodiment of the present invention.
Figure 2:
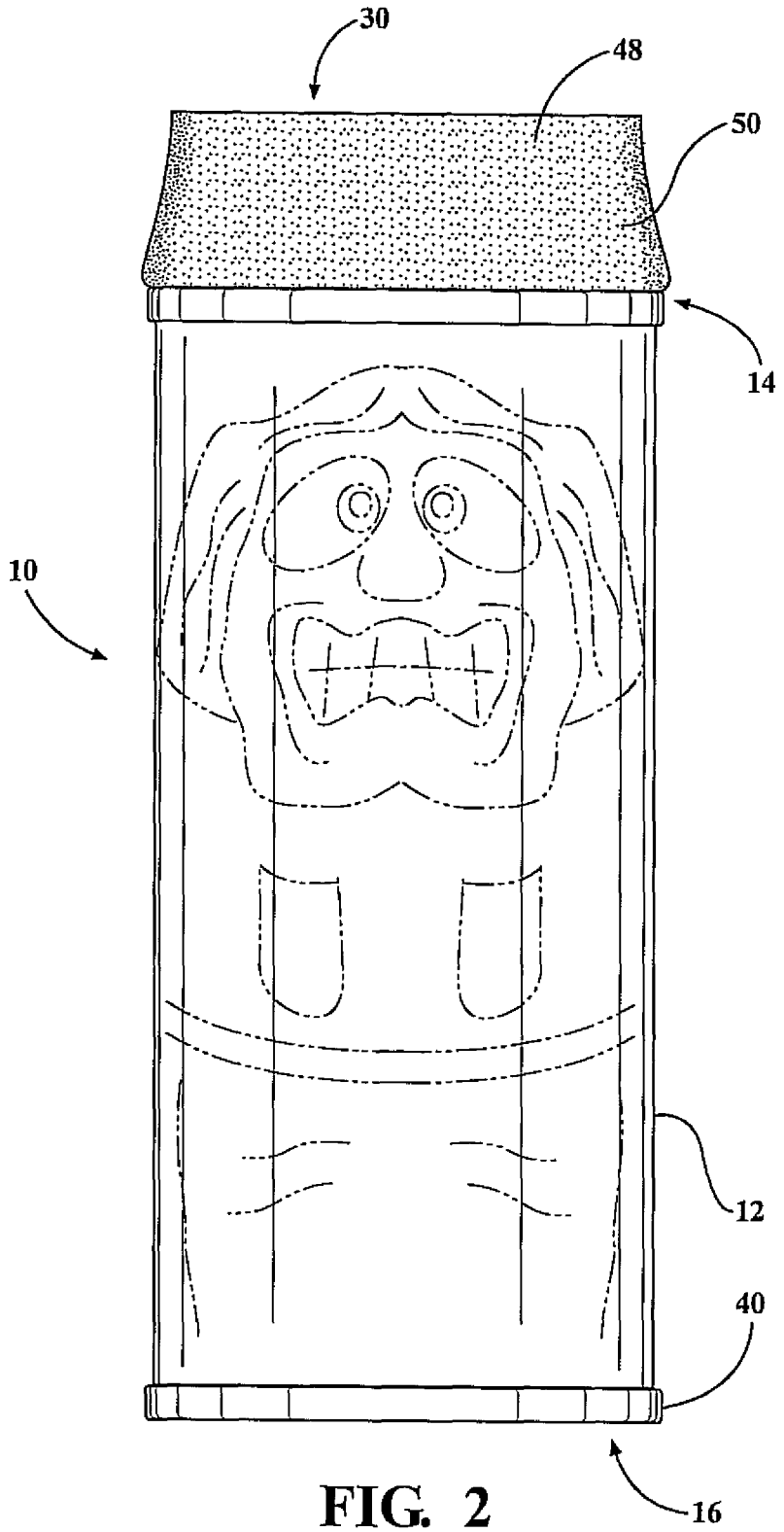
FIG. 2 is a plan side view of the toy projectile apparatus shown in FIG. 1.
Figure 3:
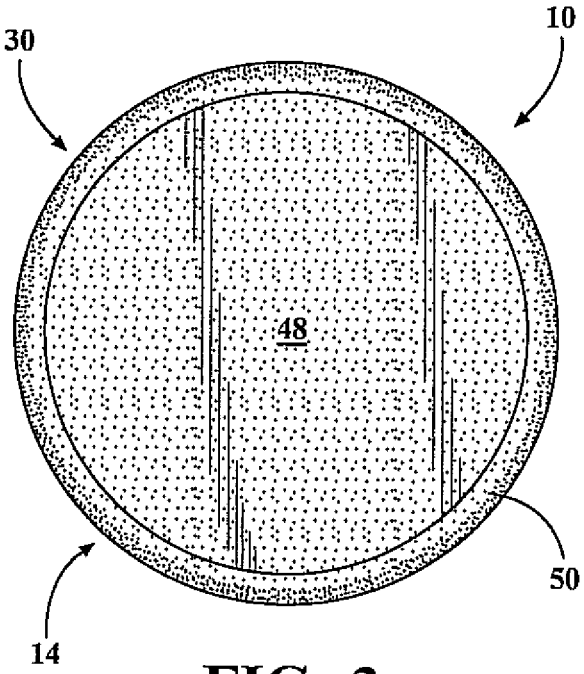
FIG. 3 is a top plan view of the toy projectile apparatus of FIG. 1.
Figure 4:
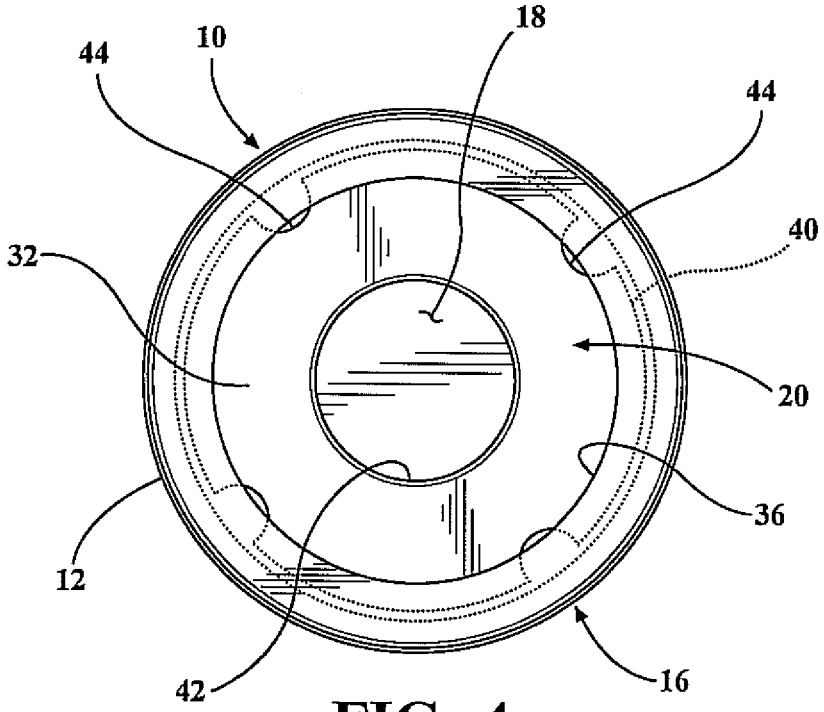
FIG. 4 is a bottom plan view of the toy projectile apparatus of FIG. 1.
Figure 5:
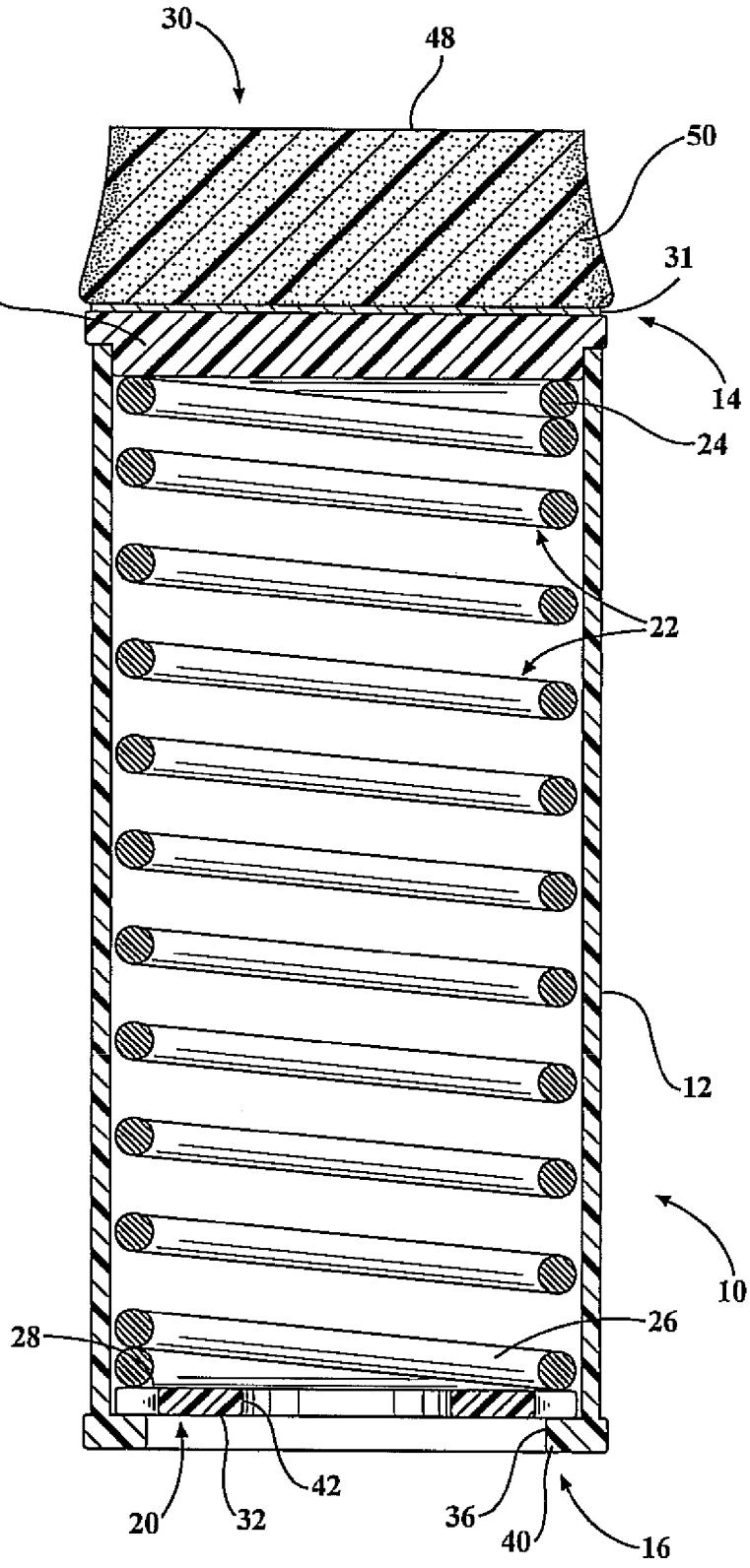
FIG. 5 is a side plan cutaway view of the toy projectile apparatus of FIG. 1 showing the spring in the uncompressed state.
Figure 6:
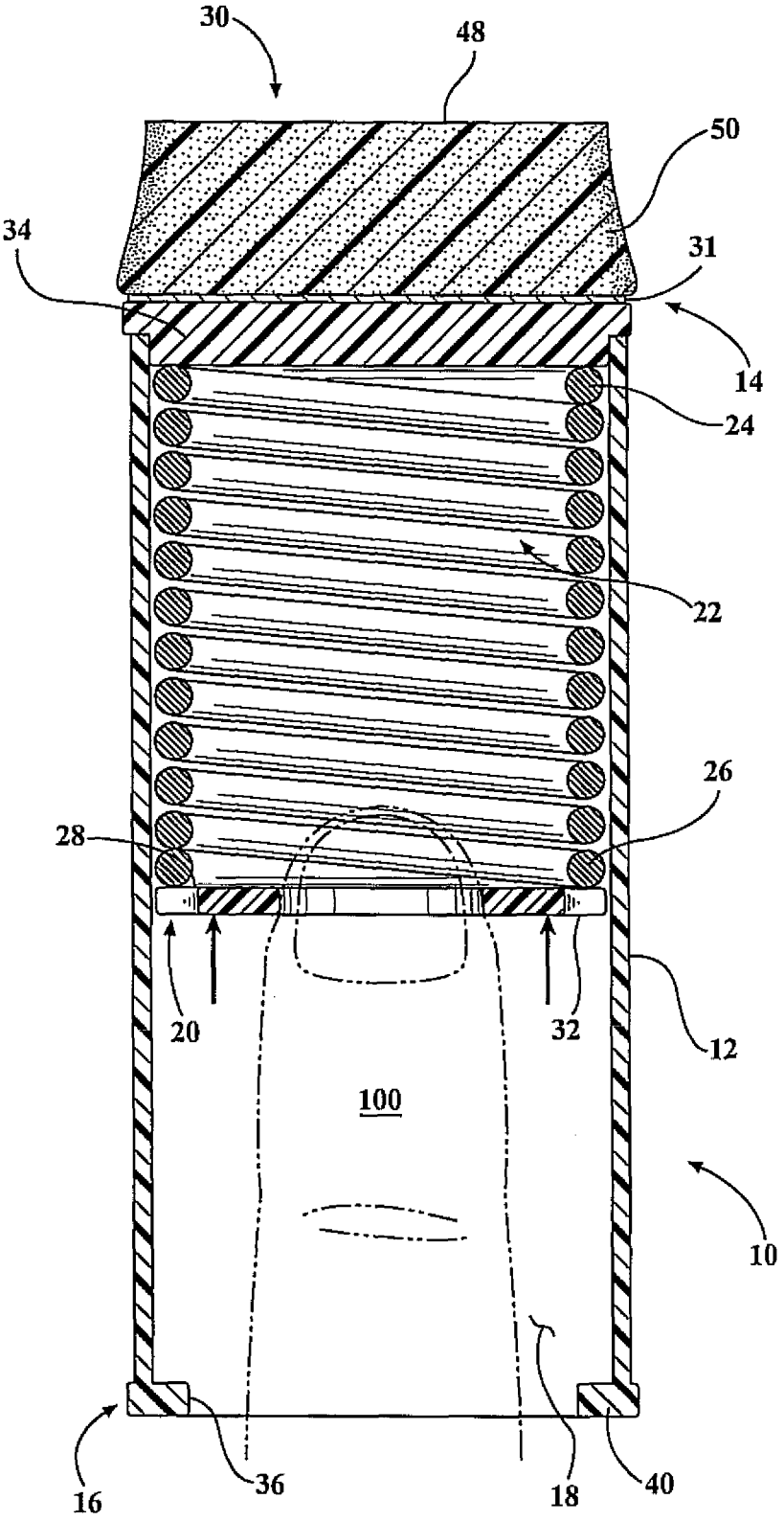
FIG. 6 is a side plan cutaway view of the toy projectile apparatus of FIG. 1 showing the spring and base member in a compressed or prelaunch orientation.

Referring now to FIGS. 1-7, one embodiment of a toy projectile apparatus 10 may include a body having a side wall 12, a closed end 14, an open end 16, and with the side wall 12 defining an open interior space 18 for the body. A base member 20 may be positioned within the interior 18 of the body and shaped or otherwise configured so that it is movable along the length of the body interior 18. A spring 22 may also be positioned in the interior 18 so that it has one end 24 in contact with the closed end 14 of the body and an opposite end 26 in contact with a face 28 of the base member 20. As a result, the spring 22 may function to bias the base member 20 towards the open end 16 of the body. A resilient member or cap 30 may also be mounted to an exterior face 31 of the closed end 14 of the body. As best shown in FIG. 6, a user may compress the spring 22 by forcing his or her finger 100 against an opposing face 32 of the base member 20 while also restraining the toy 10. And, once the spring 22 is compressed, the toy 10 may be launched by releasing the restraint on the toy 10. As best shown in FIGS. 1 and 2, an exterior surface of the side wall 12 may include indicia 102 such as labels or Referring now to FIGS. 1, 2, and 4-7, the side wall 12 of the body of the toy 10 may be formed from plastic or known synthetic material as a rounded or tubular article. However, it will be appreciated that the side wall 12 may be constructed so that the body takes on other shapes when viewed on end (see FIG. 4) such as a square, rectangle or triangle (as determined by the manufacturer's needs or desires) and using other materials such as a metal or metal alloys.

Still referring to FIGS. 1, 2, and 4-6, and as best shown in FIGS. 5 and 6, the closed end 14 of the toy 10 may be formed by adhesively bonding a closure member 34 to the side wall 12. Alternatively, the closed end 14 may be molded along with the side wall 12 as a single part along with the open 16 and closed 14 ends. As best shown in FIG. 4, the open end of 16 may feature an aperture 36 that may be generally concentric with respect to the side wall 12. And, as shown in FIGS. 4-6, a lip or flange 40 may be formed around at least a portion of the open end 16 to provide a support or biasing surface for the base member 20.

Referring now to FIGS. 4 and 5, the base member 20 may be formed as a disc or like article having a diameter less than the diameter of the interior 18 of the body and a shape that generally conforms to that of the interior 18 of the toy 10 so that the member 20 is moveable/slideable within the body. As shown in FIG. 4, the base member 20 may include a center aperture 42 that may be used as a rest or contact point for the user's finger 100. One or more cutouts or vents 44 (of predetermined shape) may also be provided along a perimeter or edge 46 of the base member 20. The cutouts 44 may function to permit proper air venting of the interior 18 during launch of toy 10 and to allow the base member 20 to more easily move within the interior 18 of the toy 10.

Referring now to FIGS. 5 and 6, the spring 22 of the toy projectile apparatus 10 may be a metal coil spring. It will, however, be appreciated that the toy may also feature a spring 22 manufactured from a plastic, metal alloy or like material.

Referring now to FIGS. 1-3, 5, and 6, the resilient member or cap 30 may be manufactured from foam rubber or like material. As shown, the cap 30 may include a planar upper surface 48 and tapered sidewalls 50. However, it will be appreciated that the cap 30 may have other shapes that may or may not be concentric to the shape of the side wall 12 depending on the design needs or desires of the manufacturer. And, in operation, it will be appreciated the cap 30 may function to cushion the impact of the toy 10.

Figure 7:
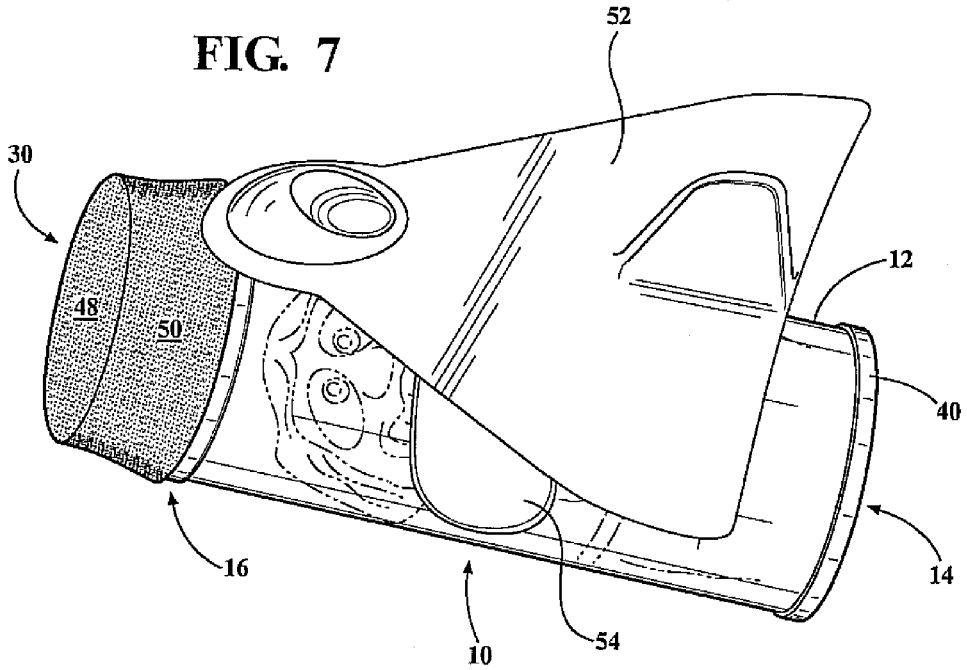
FIG. 7 is a perspective view of the toy projectile apparatus of FIG. 1 showing an embodiment of a toy accessory mounted to the toy projectile apparatus.
Figure 8:
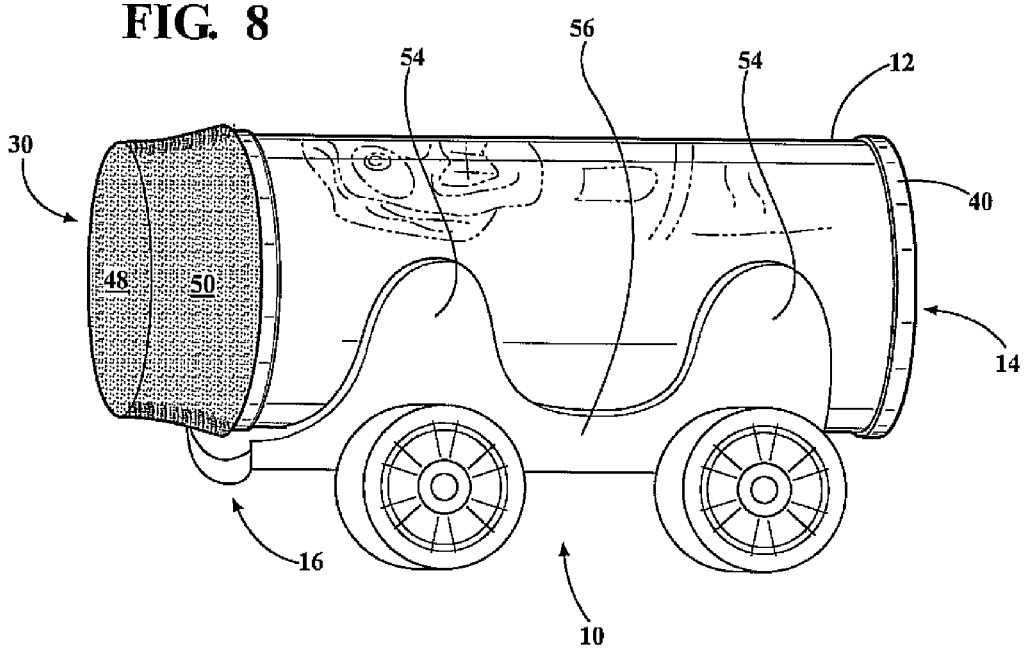
FIG. 8 is a perspective view of the toy projectile apparatus of FIG. 1 showing another embodiment of a toy accessory mounted to the toy projectile apparatus.

Referring now to FIGS. 7 and 8, one or more accessories 52 (such as a glider (FIG. 7) or wheeled cart (FIG. 8)) may be provided that may be removably mounted to the toy 10. For example, as best shown in FIG. 7, the accessory may be a toy glider that may be manufactured from material like that used to manufacture the toy 10. And, as best shown in FIG. 8, the accessory may be a toy cart that may likewise be manufactured from material like that used to manufacture the toy 10. The accessory 52 may also include a resilient clip 54 or the like for use in mounting the accessory 52 to the toy 10.

Referring now to FIGS. 1-8, and as best shown in FIG. 6, the toy 10 may be launched by grasping or otherwise restraining the side wall 12 of the toy 10 while applying a compressive force with the user's finger 100 (or the like) to the aperture 42 and opposing face 32 of the base member 20 to compress the spring 22. The toy 10 may then be launched by releasing the side wall 12—causing the action of the spring 22 and base member 20 to launch the toy 10 off the finger 100.

Having thus disclosed one or more embodiments of the invention, various additional embodiments will become apparent to those of skill in the art that do not depart from the scope and spirit of the following claims.

The invention claimed is:

1. An apparatus comprising:

an elongated body having a wall defining an open interior, and having a closed end and an open end, a base member positioned in the open interior of the body and being shaped to have a perimeter edge and to be moveable along the length of the open interior, and the base member comprising a plurality of cut-outs along the perimeter edge;

a spring positioned in the interior of the body having one end contacting the closed end of the body and another end contacting the base member so that the base member is biased toward the open end of the body; and a resilient member mounted on the exterior of the body at the closed end.

2. The apparatus of claim 1, wherein the elongated body comprises a tubular shaped body.

3. The apparatus of claim 2, wherein the base member has a diameter less than a diameter of the interior of the body.

4. The apparatus of claim 1, wherein the base member comprises a center aperture.

5. The apparatus of claim 1, wherein the spring comprises a metal coil spring.

6. The apparatus of claim 1, further comprising an accessory article having a mounting apparatus, and the elongated body being removably mounted to the accessory article by the mounting apparatus.

7. The apparatus of claim 6, wherein the mounting apparatus comprises a resilient clip.

8. A method comprising:

providing a toy article including a tubular shaped body having an open interior, a base member including a center aperture and being movably positioned in the interior of the tubular body, a spring positioned in the interior and operating to bias the base member toward one end of the interior, and a resilient cap positioned on an exterior of the body at an end opposite from the biased base member;

receiving a tip of the human finger in the center aperture of the base member;

compressing the spring by applying a force against the base member with the human finger while restraining movement of the body; and launching the toy article in a direction away from the direction of the force while releasing the body.

9. The method of claim 8, further comprising:

providing an accessory article having a mounting apparatus, and the body being removably mounted to the accessory article by the mounting apparatus before application of the compressing force to the spring.

10. An apparatus consisting of:

a tubular shaped body having a closed end, an open end and an open interior, the open end having an interior lip portion;

a base member positioned in the interior of the tubular shaped body, the base member having a diameter less than a diameter of the interior of the tubular shaped body so that the base member is moveable along the length of the open interior, and base member further including a plurality of cut-outs along a perimeter thereof and having a center aperture;

a coil spring positioned in the interior of the body having a first end contacting the closed end of the body and an opposite end of the base member so that the base member is biased against the interior lip of the open end of the body; and a resilient cap mounted on the exterior of the body at the closed end.

* * * * *